US008414250B2

(12) United States Patent
Hansen et al.

(10) Patent No.: US 8,414,250 B2
(45) Date of Patent: Apr. 9, 2013

(54) GEARED TURBINE MACHINE FOR A MACHINE TRAIN, MACHINE TRAIN WITH AND GEAR FOR GEARED TURBINE MACHINE

(75) Inventors: Ole Hansen, Hamminkeln (DE); Arindam Khan, Oberhausen (DE); Klaus-Dieter Mohr, Wuppertal (DE); Gerd-Ulrich Woelk, Oberhausen (DE); Hans-Otto Jeske, Wesel (DE)

(73) Assignee: MAN Diesel & Turbo SE, Augsburg (DE)

( * ) Notice: Subject to any disclaimer, the term of this patent is extended or adjusted under 35 U.S.C. 154(b) by 939 days.

(21) Appl. No.: 12/473,445

(22) Filed: May 28, 2009

(65) Prior Publication Data

US 2009/0297337 A1 Dec. 3, 2009

(30) Foreign Application Priority Data

May 29, 2008 (DE) ..... 10 2008 025 695
Jun. 25, 2008 (DE) ..... 10 2008 030 103
Jul. 1, 2008 (DE) ..... 10 2008 031 116

(51) Int. Cl.
*F04D 25/16* (2006.01)

(52) U.S. Cl. ..... 415/60; 415/62; 415/124.1; 416/120; 416/170 R; 416/175; 416/203

(58) Field of Classification Search ..... 415/124.1, 415/43, 60, 62; 416/54, 120, 170 R, 203
See application file for complete search history.

(56) References Cited

U.S. PATENT DOCUMENTS 5,154,571 A * 10/1992 Prumper ..... 415/60
5,382,132 A * 1/1995 Mendel ..... 415/60
5,402,631 A * 4/1995 Wulf ..... 60/783
7,559,200 B2 * 7/2009 Rodehau et al. ..... 60/612

* cited by examiner

*Primary Examiner* — Ninh H Nguyen
(74) *Attorney, Agent, or Firm* — Cozen O'Connor

(57) ABSTRACT

A machine train includes a drive unit, preferably a steam turbine with axial exhaust flow, a geared turbine machine, and an additional compressor. The geared turbine machine has an integrated gear train with a drive pinion for driving turbine machine rotors via a large gear, and an output pinion of a rotational speed reduction power gear for driving the additional compressor.

22 Claims, 7 Drawing Sheets

GEARED TURBINE MACHINE FOR A MACHINE TRAIN, MACHINE TRAIN WITH AND GEAR FOR GEARED TURBINE MACHINE

BACKGROUND OF THE INVENTION

1. Field of the Invention

The present invention relates to a geared turbine machine, preferably a radial geared turbine machine, with an integrated power gear for a machine train, an integrated power gear for such a geared turbine machine, as well as a machine train with such a geared turbine machine and a further compressor, preferably a main compressor.

2. Description of the Related Art

Generally a machine train includes a drive unit, for example a steam turbine, a gas turbine or an expander, more preferably an expansion or residual gas turbine, and one or a plurality of compressors driven by these drive units for example for the compression of air or other gases.

From internal practical operation machine, trains are known wherein a double-driving steam turbine on one side drives a booster compressor with a plurality of compressor stages and on an opposite side of the steam turbine drives a main compressor which draws in, compresses a medium and charges the booster compressor with a part mass flow thereof, which the latter further compresses for example to one to three pressure stages.

Here, the rotational speeds of steam turbine, main compressor, and booster compressor have to be matched to one another. While for thermodynamic reasons the rotational speeds of the steam turbine and the compressor stages of the booster compressor should be relatively high, they are however lower for the main compressor—because of its large diameters and the high centrifugal forces connected therewith—and in the past have limited the rotational speed of the steam turbine, which is disadvantageous in terms of its efficiency and its size.

It is therefore known according to internal company practice to design the booster compressor as a geared compressor as disclosed, for example, by US2006/156728, which discloses a geared compressor with an integral gear according to U.S. Pat. No. 5,382,132, in order to operate the compressor stages at higher rotational speeds than the main compressor. U.S. Pat. No. 3,826,587 discloses a three-stage geared compressor wherein the drive rotational speed is stepped up into higher rotational speeds in the compressor stages.

DE-GM 7122098 discloses reducing the rotational speed of a steam turbine through a separate spur gear in front of the main compressor, however because of the separate gear this not only increases the manufacturing and assembly expenditure, but also the axial length of the machine train and thus transport and building costs.

Known machine trains have further disadvantages. The previous arrangement of main compressor and booster compressor thus requires a radial exhaust flow from the steam turbine on both sides of the steam turbine. This worsens the efficiency. If a condenser is connected downstream of the steam turbine this condenser charged with the radially exhausting steam has to be arranged in a horizontal plane above or below the steam turbine which substantially increases the height of the entire machine train and thus more preferably the costs for the foundation and building accommodating it.

SUMMARY OF THE INVENTION

An object of the present invention is to reduce at least one of the aforementioned disadvantages and improve a machine train.

According to a first aspect of the present invention, a rotational speed reducing power gear, which is arranged between drive unit and a compressor, is integrated in a gear of a geared turbine machine, thus separating it from the compressor at the same time.

To this end, a geared turbine machine for a machine train includes a drive pinion which is connected with a drive shaft in a rotationally fixed manner, a large gear intermeshed with the drive pinion and one or more, preferably three or four, turbine machine rotors. These turbine machine rotors of the geared turbine machine each have a turbine machine shaft, one or more, preferably two blade wheels connected with the turbine machine shaft in a rotationally fixed manner, and a turbine machine pinion connected with the turbine machine shaft in a rotationally fixed manner, wherein the turbine machine pinion of one or a plurality of turbine machine rotors intermeshes with the large gear.

Here, a blade wheel of a turbine machine rotor can be designed as compressor or expander blade wheel. More preferably, two or a plurality of compressor blade wheels of the same turbine machine rotor and/or compressor blade wheels of various turbine machine rotors, preferably designed as radial compressors, can form compressor stages of the geared turbine machine which acts as geared compressor. Alternatively, two expander blade wheels of the same turbine machine rotor and/or expander blade wheels of different turbine machine rotors can form expander stages of a geared turbine machine designed as radial expander, which acts as geared expander. Both embodiments can also be combined in that for example at least one turbine machine rotor equipped with one or a plurality of compressor blade wheels forms one or a plurality of compressor stages and at least one other turbine machine rotor equipped with one or a plurality of expander blade wheels forms one or a plurality of expander stages of the same geared turbine machine, and/or in that one or a plurality of turbine machine rotors are each equipped with at least one compressor and at least one expander blade wheel each and thus form both a compressor and also an expander stage. Thus, here, both pure single or multi-stage geared compressors with one or a plurality of compressor shafts equipped with at least one compressor blade wheel, pure single or multi-stage geared expanders with one or a plurality of expander shafts equipped with at least one expander blade wheel are also designated combined geared compressor/expander ("geared compander") generalised as geared turbine machine, its rotors equipped with compressor and/or expander blade wheels are designated turbine machine rotor.

According to the invention, the geared turbine machine now additionally has an output pinion of a rotational speed reduction power gear which is connected in a rotationally fixed manner with an output shaft for driving a compressor drive shaft of a further compressor separated from the geared turbine machine, preferably a main compressor of the machine train that can be coupled with this output shaft, which can preferably be designed as single shaft compressor, preferably as axial compressor, radial compressor, embodied for example with horizontal and parting joint or as isothermal compressor or as combined axial-radial compressor.

This output pinion, like the large gear, intermeshes with the drive pinion preferably on a side of the drive pinion located opposite the large gear. A geared turbine machine according to the invention thus combines for the first time a multiple shaft gear of a geared turbine machine and a power gear for a compressor separated from the latter.

An integral gear, a geared turbine machine with such an integral gear or a machine train according to this first aspect of the present invention has a number of advantages: a drive unit, for example a steam turbine, a gas turbine or an expander, more preferably an expansion or residual gas turbine, a further compressor, preferably a main compressor and the turbine machine rotors of the geared turbine machine can each be driven by the rotational speed reduction power gear in the rotational speed ranges favourable for these.

For example the rotational speed reduction power gear can reduce a rotational speed of the drive pinion with a gear ratio to a rotational speed of the output pinion, which is in the range from 1.25 to 1.45, preferably in the range from the 1.3 to 1.4 and more preferably in the range between 1.32 to 1.38. Here, a gear ratio is defined as is usual in the industry as the quotient amount of drive rotational speed to output rotational speed, in this case of drive pinion rotational speed divided by the output pinion rotational speed, so that a direction of rotation reversal is also described by a positive gear ratio. Accordingly, a turbine machine pinion can have a gear ratio with the drive pinion which is in the range from 0.28 to 0.54, preferably in the range from 0.30 to 0.52 and more preferably in the range between 0.32 to 0.50, wherein the gear ratio is the quotient of output pinion rotational speed divided by turbine machine pinion rotational speed.

As a result, a steam turbine can be operated at a rated rotational speed within a range from 4000 to 7000 revolutions per minute (rpm), the turbine machine rotors of a booster compressor designed as geared turbine machine at a rated rotational speed within a range from 10000 to 17000 rpm, and a main compressor designed as single shaft compressor at a rated rotational speed within a range from 2000 to 6000 rpm. This increases the efficiency of the steam turbine which can also be constructed smaller size.

Drive and output pinion in this case form a power gear via which a major part of the power supplied by the drive unit, which in the case of steam turbines can for example be within the range from 40 to 80 MW, can be transmitted to the additional compressor which for example is subjected to a power load within the range between 30 to 50 mw. Preferably at least half, particularly preferably at least 60% of the power is transmitted from the drive shaft to the output shaft. The large gear distributes the remaining differential power in accordance with the turbine machine rotors intermeshing with said large gear. Advantageously the tooth length of the turbine machine pinions and the large gear can thus be designed smaller and preferably amount to a maximum of 0.91 times of the tooth length of the drive pinion.

As a further significant advantage for reducing the drive unit rotational speed to the rotational speed of the additional compressor, no separate gear is required which saves manufacturing and assembly expenditure as well as space.

The additional compressor is preferably accommodated in a housing separated from a housing of the geared turbine machine. Because of this, decoupling in terms of vibration between the geared turbine machine and the additional compressor can be very advantageously achieved. To this end, the additional compressor is preferably spaced from the geared turbine machine in axial direction, which is more preferably an advantage also when the additional compressor as main compressor is large in size.

Through the integration according to the invention of a rotational speed reduction power gear of an additional compressor, more preferably a main compressor, in a geared turbine machine the power gear is not accommodated in the housing of the additional compressor, which can be an advantage in terms of vibration.

As explained above, the geared turbine machine can have one or more expander stages in which one or a plurality of turbine machine rotors are each equipped with at least one, two or a plurality of expander blade wheels. As a result, a waste medium of the process converted in the machine train and/or the process medium previously compressed in the main compressor, preferably a part mass flow thereof, can for example be advantageously expanded and its enthalpy used for driving the additional compressor and/or compressor stages of the geared turbine machine.

Additionally or alternatively the geared turbine machine, which then acts as booster compressor of the machine train, can have one or more compressor stages in that one or a plurality of turbine machine rotors are each equipped with at least one, two or a plurality of compressor blade wheels. As a result, the medium compressed in the additional compressor for example, preferably a part mass flow from the main compressor, can be further compressed in order for example to act as coolant following re-cooling and expansion. In addition or alternatively, other media which do not flow through the additional compressor can be compressed in compressor stages of the geared turbine machine. The geared turbine machine can thus act simultaneously as working and/or power machine, wherein the turbine machine shafts exert a rotational moment on a blade wheel or are subjected by the latter to a rotational moment.

In addition or alternatively an electrical machine supporting the drive unit and/or that can be driven by the drive unit, more preferably a motor, a generator or a motor/generator can be provided whose electrical machine input shaft intermeshes with the drive pinion, the large gear, the output pinion or a turbine machine pinion or is coupled or connected in a rotationally fixed manner with the drive shaft, the output shaft, the shaft of the large gear or a turbine rotor. In this manner additional drive rotational moment for example can be introduced through an electric motor into the geared turbine machine or mechanical power available there converted into electrical power in a generator and for example be stored, made available to the machine train or fed into a power network.

If a medium which was previously compressed in the main compressor flows through the booster compressor, the flow cross sections and thus housing, blade wheel or blading diameter of the geared turbine machine, because of the higher pressures and especially upon through-flow of only a part mass flow from the main compressor, can be designed smaller than with the additional compressor. The smallest flow cross section of the additional compressor thus is at least 1.05 times, preferably at least 1.1 times, and more preferably at least 1.2 times the smallest flow cross section of the geared turbine machine. A rotationally fixed connection, for example between drive pinion and drive shaft, turbine machine pinion and turbine machine shaft or output pinion and output shaft here means both a releasable connection which for example can include a spline and/or screws as well as a permanent connection, more preferably a welded connection or an integral design, for example as one-piece original and/or formed part.

Coupling between the output shaft and the separate compressor drive shaft that can be coupled with the former can be realized via a flange connection, a coupling to compensate for axial and/or angular offset and/or a shiftable or self-shifting coupling, for example an overload coupling. To that extent, output shafts and compressor drive shafts which are preferably releasably or permanently connected with each other are described as capable of being coupled. A coupling between output shaft and compressor drive shaft can dampen rotational vibrations, axial shocks or the like.

Intermeshing in terms of the present inventions on the one hand means direct engagement, i.e. meshing of teeth, for example single or double helical toothing, of the two elements intermeshing with each other. However, in the same way this also includes indirect engagement subject to the intermediate connection of one or a plurality of gear stages, preferably spur-gear and/or planetary gear stages, such as is known from U.S. Pat. No. 5,382,132, the disclosure of which is expressly incorporated herein by reference. If a geared turbine machine according to the first aspect of the present invention has two or more turbine machine rotors, all turbine machine pinions can intermesh with the large gear, which makes possible a more even loading of the large gear and a narrower construction of the geared turbine machine. Equally, one or a plurality of turbine machine pinions can also intermesh with the output pinion. This increases the distance of these turbine machine rotors to those driven by the large gear, which increases the design freedom of the individual turbine machine rotors or the compressor and/or expander stages formed by these turbine machine rotors.

In a preferred embodiment an axis of rotation of the drive pinion, an axis of rotation of the large gear and an axis of rotation of the output pinion are arranged in a common, preferably largely horizontal plane. This reduces the height of the geared turbine machine vertically to this plane. The axis of rotation of a turbine machine pinion intermeshing with the large gear and/or the axis of rotation of a turbine machine pinion intermeshing with the output pinion can likewise be arranged in this plane and thus further reduce the height. If additional turbine machine pinions intermesh with the large gear, their axes of rotation are preferably arranged in a further common plane which is parallel to the plane in which the axis of rotation of the large gear is located.

Preferably a geared turbine machine includes a multi-part housing which accommodates the drive pinion, the large gear, the output pinion and the turbine machine pinions. When the axes of rotation as explained above are located in one or two planes, preferably horizontally located parallel to each other, it is preferred that this housing is split in this plane or these planes. This simplifies assembly and maintenance.

The output pinion and the large gear are preferably arranged in the same transverse plane of the drive pinion. As a result of this, the construction of the geared turbine machine is advantageously particularly short axially. Equally, large gear and output pinion can also be arranged in axially offset planes, wherein the large gear or the drive pinion are then advantageously designed in two stages and have two different pitch circle diameters for engagement with drive and turbine machine pinions (in the case of two-stage large gear) or for engagement with large gear and output pinion (in the case of two-stage drive pinion). Such an arrangement allows narrower construction in the plane of the axes of rotation of drive pinion and large gear.

Preferably not all but only some of drive pinion, large gear, turbine machine pinions and the output pinion are axially amounted in a housing of the geared turbine machine which to this end may have two to six axial bearings. The remaining of drive pinion, large gear, turbine machine pinions and output pinion can then axially support themselves on these elements axially mounted in the housing of the geared turbine machine, more preferably via thrust collars, as known from U.S. Pat. No. 5,382,132. As a result, with reduced construction expenditure the axial thrust of the blade wheels or the drive unit can be absorbed.

The additional compressor in a machine train of the invention can be arranged on the side of the geared turbine machine located opposite the drive unit. It then becomes possible to design the drive unit, which is thus free on the side opposite the geared turbine machine, as a steam turbine with axial exhaust flow. Because of this, in contrast with conventional machine trains with steam turbines having a radial exhaust flow, not only the efficiency is improved. It is also possible to arrange a condenser connected downstream of the steam turbine substantially on the same horizontal plane, which reduces the height of such a machine train. Accordingly, according to a second aspect of the present invention, a steam turbine with axial exhaust flow as drive unit is provided with a machine train with a geared turbine machine and an additional compressor, preferably a main compressor. The first and second aspects of the present invention explained above each solve the object of improving a machine train mentioned at the outset. Particularly advantageously, both aspects are combined with each other but this is not mandatory.

In the following, both aspects are therefore jointly explained by means of exemplary embodiments of the present invention which make use of both aspects, while it is expressly emphasized that the present invention necessarily only includes at least the features of the first or second aspect. Accordingly, further features and advantages of both aspects are illustrated by these exemplary embodiments.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
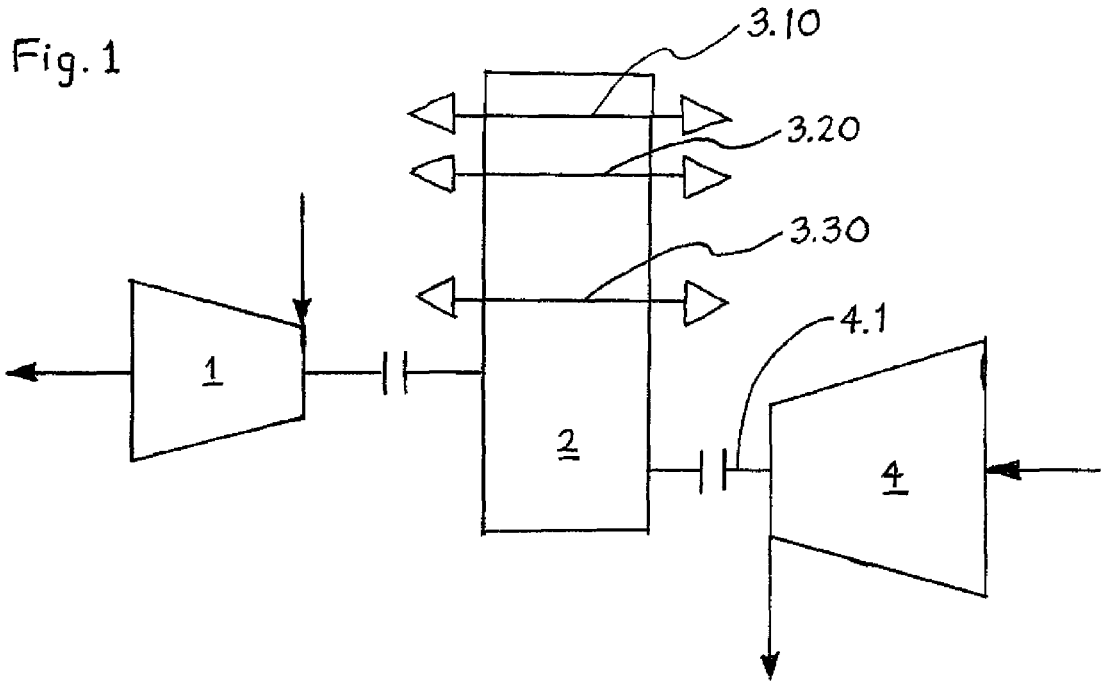
FIG. 1 is a schematic plan view of a machine train with a geared turbine machine with integral gear according to a first embodiment of the present invention.

FIGS. 1 and 3 show the substantial elements of a machine train according to a first embodiment of the present invention, wherein the first and second aspects of the present invention are jointly realized.

Initially making reference to FIG. 1, a main compressor 4 is designed as single-shaft compressor with axial intake which in the manner indicated by an arrow draws in and compresses air for example to 7 bar.

A part mass flow of this compressed air is then fed to a first turbine machine rotor 3.10 of a booster compressor designed as geared turbine machine 2, explained in more detail in the following.

Figure 3A:
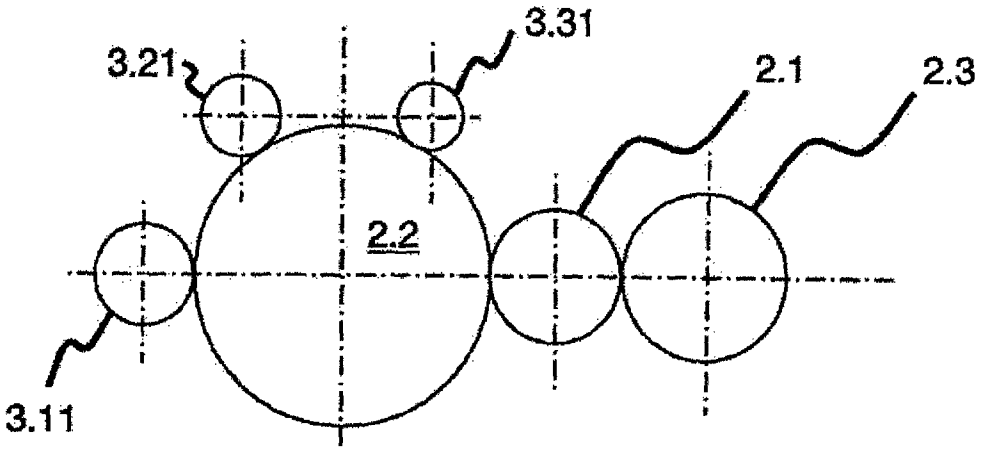
FIG. 3A is a schematic plan view of a gear arrangement of the geared turbine machine according to FIG. 1.
Figure 3B:
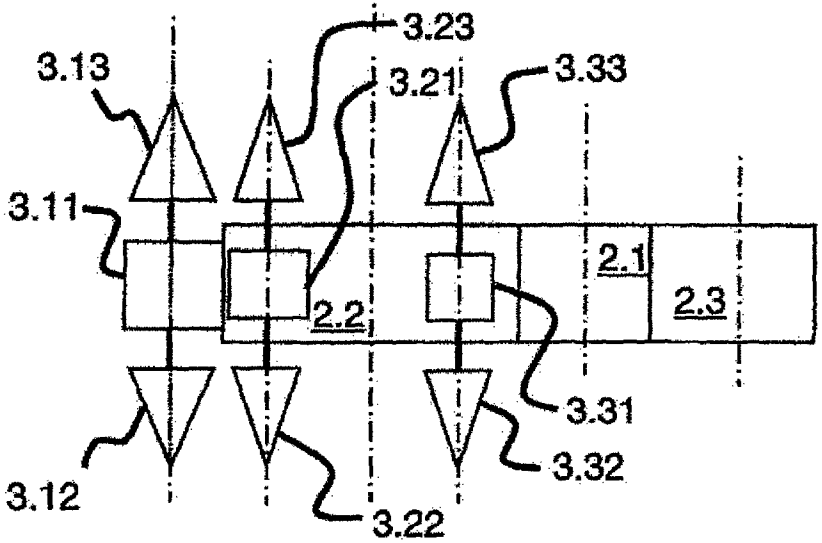
FIG. 3B is a schematic plan view of the gear arrangement according to FIG. 3A.

The first turbine machine rotor 3.10 in this case has two compressor blade wheels 3.12, 3.13, indicated by triangles in FIG. 3B which sit on a common turbine machine shaft and rotate in spiral housings (not shown) in order to further compress the air fed in by the main compressor 4, thus forming two compressor stages of the booster compressor 2. From these the air is then fed to a second turbine machine rotor 3.20 of the booster compressor 2 whose two compressor blade wheels 3.22, 3.23, likewise indicated by triangles in FIG. 3B, have a smaller diameter and rotate faster than the blade wheels of the first turbine machine rotor 3.10 in order to further compress the air and thus form two additional compressor stages of the booster compressor 2. The air further compressed therein is then fed to a third turbine machine rotor 3.30 of the booster compressor 2, whose two compressor blade wheels 3.32, 3.33 (FIG. 3B) again have a smaller diameter and rotate faster than the blade wheels of the second turbine machine rotor 3.20 in order to finally compress the air to its desired end pressure of 75 bar thus forming two additional compressor stages, the booster compressor 2 thus having a total of six stages. As for the rest, three turbine machine rotors 3.10, 3.20 and 3.30 of the booster compressor 2 however are constructed identically.

As shown in more detail in the axial view of FIG. 3A and plan view of FIG. 3B, turbine machine pinions 3.11, 3.21 and 3.31 are connected with the turbine machine shafts of the respective turbine machine rotors 3.10, 3.20 and 3.30 on which the blade wheels 3.12 and 3.13, 3.22 and 3.23, and 3.32 and 3.33 are seated, for example cut on to the turbine machine shaft or attached to it as a separate pinion via a shaft-hub connection. All three turbine machine pinions 3.11, 3.21 and 3.31 intermesh with a common large gear 2.2 of the booster compressor 2 thus designed as multiple shaft compressor. In order to realize the various rotational speeds of the three turbine machine rotors, the turbine machine pinion 3.11 of the first turbine machine rotor 3.10 rotating the slowest has the largest diameter, the turbine machine pinion 3.31 of the third turbine machine rotor 3.30 rotating the fastest has the smallest diameter. Obviously, as a modification of the exemplary embodiment, more, for example four or five turbine machine rotors each with one, two or more blade wheels is possible.

The large gear 2.2 in turn is driven by a drive pinion 2.1 of a smaller diameter which is connected in a rotationally fixed manner with a drive shaft of a steam turbine 1 (FIG. 1) or another drive unit, for example a gas turbine or an expander, so that the turbine rotational speed transmitted to the turbine machine shafts of the three turbine machine rotors 3.10, 3.20, 3.30 is stepped up with different gear ratios.

According to the first aspect of the present invention, the axis of rotation of an output pinion 2.3 is arranged in the same horizontal plane in which the axes of rotation of the drive pinion 2.1, of the large gear 2.2 and the turbine machine pinion 3.11 are arranged, which intermeshes with the drive pinion 2.1 on the side located opposite the large gear 2.2. Drive pinion 2.1, large gear 2.2 and output pinion 2.3 are arranged in the same transverse plane (drawing plane of FIG. 3A) so that the same toothing of the drive pinion 2.1 mesh both with the large gear 2.2 and also the output pinion 2.3. As is schematically indicated in FIG. 3B the tooth length of the turbine machine pinions 3.11, 3.21, 3.33 is smaller than that of the drive and output pinions 2.1, 2.3 because of the different rotational flux.

The diameter of the output pinion 2.3 is larger than the diameter of the drive pinion 2.1, so that the rotational speed of the steam turbine 1, which drives the drive pinion 2.1 seated on its drive shaft is stepped down to the output shaft with the output pinion 2.3. The output shaft with the output pinion 2.3 is connected through a coupling indicated in FIG. 1 with a compressor drive shaft 4.1 of the main compressor 4 (FIG. 1) designed as single shaft compressor, so that the turbine 1 drives the main compressor 4 with a reduction gear ratio. Drive pinion 2.1 and output pinion 2.3 thus form a power gear stepping down the rotational speed via which the major part of the turbine power is transmitted to the main compressor 4.

Because of the step down or step up gear of the turbine or drive pinion rotational speed to the slower output pinion rotational speed or faster turbine machine pinion speeds, steam turbine 1, booster compressor 2 and main compressor 4 can be simultaneously operated in optimum rotational speed ranges. More preferably the rotational speed of the steam turbine 1 with lower main compressor rotational speed can be higher, which improves the efficiency of the steam turbine 1 and allows the use of smaller, faster rotating steam turbines. Because of the design as integral gear, no separate power gear is required for this purpose, and the machine train and foundation can be of a more compact design.

Drive and output pinion 2.1, 2.3 of the large gear 2.2 as well as the turbine machine pinions 3.11, 3.21 and 3.31 intermeshing with the latter are accommodated in a common housing (not shown). This three-part housing is horizontally split in the plane indicated in FIG. 3A as dash-dotted line in which the rotational axes of drive and output pinion 2.1, 2.3, large gear 2.2 and turbine machine pinion 3.11 are located, so that these can be assembled in a first, lower housing part in a simple manner, on which a second, middle housing part is placed.

The axes of rotation of the turbine machine pinions 3.21, 3.31 of the respective second and third turbine machine rotors 3.20 and 3.30 are located in a further horizontal plane, indicated by a dash-dotted line in FIG. 3A, which is parallel to the plane in which the axes of rotation of drive and output pinion 2.1, 2.3, large gear 2.2 and turbine machine pinion 3.11 are located. The housing is likewise horizontally split in this manner, so that after the placement of the middle housing part the turbine machine pinions 3.21, 3.31 can be assembled in the middle housing part in a simple manner, on to which a third upper housing part is placed. Through the arrangement of both turbine machine pinions 3.21, 3.31 in the additional horizontal plane vertically above the plane of drive, output pinion and large gear axis of rotation, no construction space below the large gear 2.2 for arranging turbine machine rotors is required.

The main compressor 4 has a housing separated from the booster compressor 2 and is connected with the latter only via the compressor drive shaft 4.1. Thus the two housings of main compressor and booster compressor, which for example rest on a concrete or metal foundation (not shown), can advantageously be largely decoupled in terms of vibration.

As evident in FIG. 1, the steam turbine 1 drives the booster compressor 2 and the main compressor 4 arranged on the side opposite from the steam turbine with only one drive shaft. In contrast with the previous double-driving turbines, such a steam turbine has other natural frequencies or critical rotational speeds. Preferably the range between neighboring natural frequencies or critical rotational speeds, from which adequate distance is to be maintained in operation in order to avoid resonance problems, can be advantageously increased and thus the permissible operating range expanded. The arrangement of booster compressor 2 and main compressor 4 on the same side of the steam turbine 1 allows an axial exhaust flow from the steam turbine 1 to the side located opposite the main compressor 4 and booster compressor 2 (to the left in FIG. 1) indicated by an arrow according to the second aspect of the present invention. This improves the efficiency of the steam turbine.

The axial exhaust steam from the steam turbine 1 flows into a condenser (not shown) connected downstream of the turbine 1. Conventional machine trains, wherein booster compressor and main compressor are arranged on both sides of the steam turbine, require radial exhaust flow and thus an arrangement of a downstream condenser in vertical direction above or below the plane of the steam turbine and consequently a two-tier foundation structure with corresponding vertical height. In contrast to this the condenser of a machine train according to the second aspect of the present invention, because of the axial exhaust flow of the steam turbine 1, can be substantially arranged on the same horizontal plane as the steam turbine. This makes possible a single-tier construction of the machine train, which because of the more compact foundation and the lower construction and thus building height results in considerable cost savings. This is further supported by the arrangement of the axes of rotation of drive pinion, output pinion, large gear and turbine machine pinion in the same plane or in a further horizontal plane arranged vertically above and parallel thereto.

Figure 2:
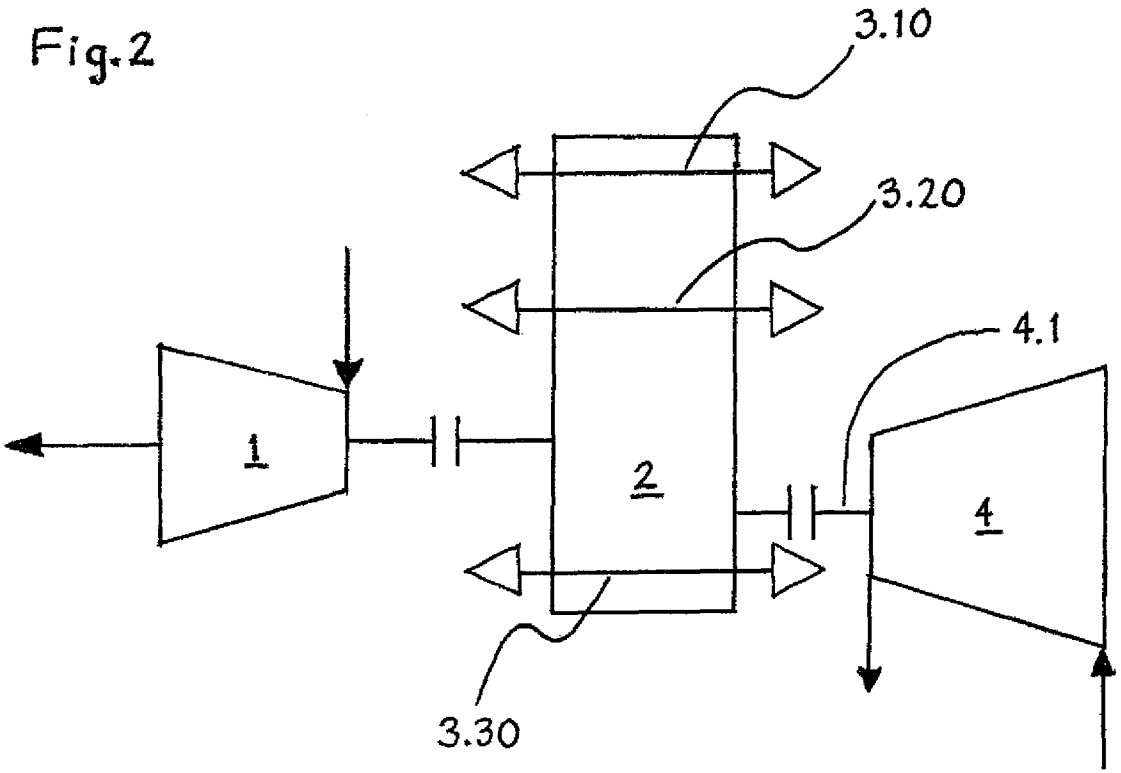
FIG. 2 is a schematic plan view of a machine train with a geared turbine machine with integral gear according to a second embodiment of the present invention.
Figure 4A:
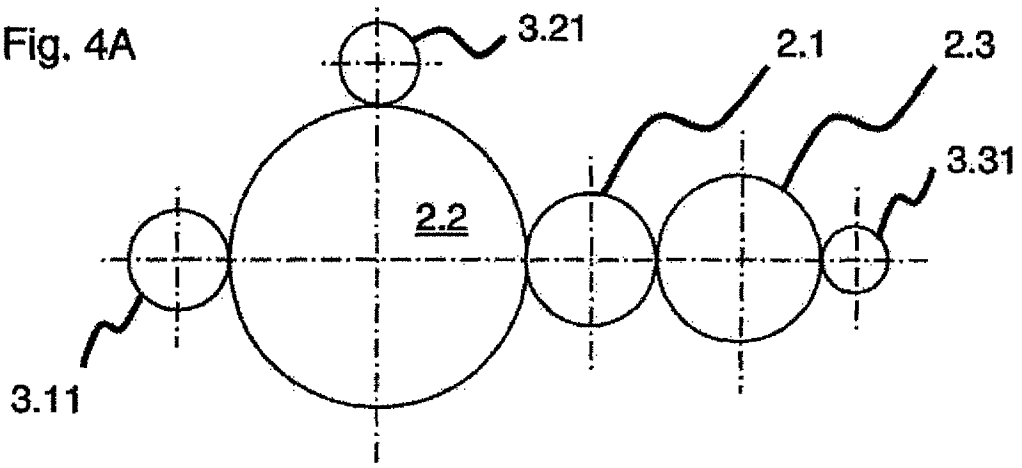
FIG. 4A is a schematic plan view of a gear arrangement of the geared turbine machine according to FIG. 2.
Figure 4B:
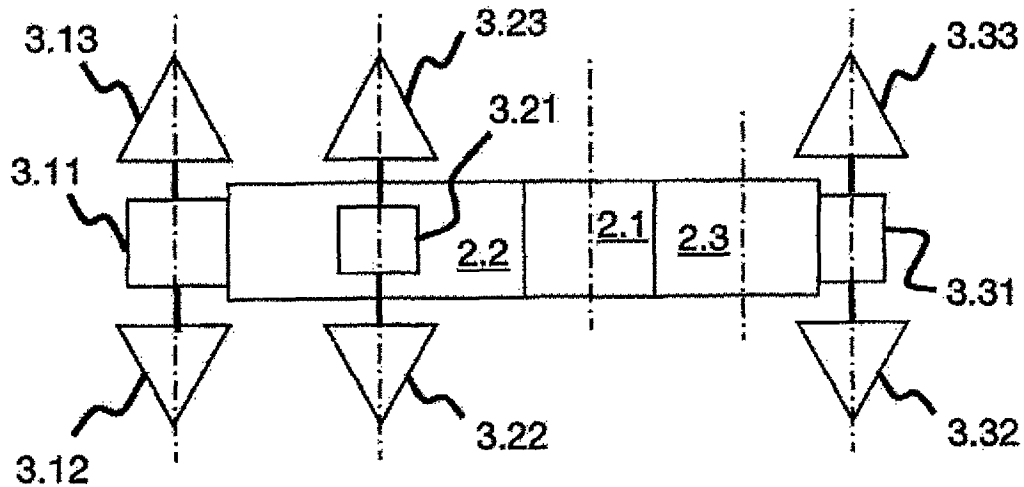
FIG. 4B is a schematic plan view of the gear arrangement according to FIG. 4A.

FIGS. 2 and 4 show the substantial elements of a machine train according to a second embodiment of the present invention, which substantially corresponds with the first embodiment and wherein the first and second aspect of the present invention are likewise jointly realized. Elements corresponding with the first embodiment are marked with identical reference symbols so that to that extent reference is made to the above explanations with regard to the first embodiment which is substantially identical in construction and merely the differences between first and second embodiment are discussed in the following.

As indicated in FIG. 2 by an arrow, the main compressor 4 in the second embodiment has a radial intake. The booster compressor 2 of the second embodiment differs from the booster compressor 2 of the first embodiment in the arrangement of the second and third turbine machine rotor 3.20, 3.30. While the axes of rotation of their turbine machine pinions 3.21, 3.33 are located in a common additional horizontal plane as shown in FIG. 3A, which is parallel to the axis of rotation of drive pinion, output pinion and large gear, with the second embodiment according to FIG. 4, only the turbine machine pinions 3.11, 3.21 of the first and second turbine machine rotor 3.10, 3.20 intermesh with the large gear 2.2, while the turbine machine pinions 3.11, 3.21 of the first and second turbine machine rotor 3.10, 3.20 and the drive pinion 2.1 intermesh with the large gear 2.1 preferably each offset by 90° in circumferential direction. That is, the axis of rotation of the second turbine machine pinion 3.21 is located between the axis of rotation of the drive pinion 2.1 and of the turbine machine pinion 3.11 of the first turbine machine rotor and vertically above the common horizontal plane of drive pinion, output pinion 2.1, 2.3, large gear 2.2 and turbine machine pinion 3.11. In this common horizontal plane is located the axis of rotation of the turbine machine pinion 3.31 of the third turbine machine rotor 3.30, which intermeshes with the output pinion 2.3 on the side of the output pinion located opposite the drive pinion 2. The pinion 3.31 is thus driven by the drive pinion 2.1 not via the large gear 2.2 but via output pinion 2.3.

As with the first embodiment, the direction of rotation of the drive shaft in the turbine machine shafts can be maintained through the intermediate connection of large gear 2.2 and output pinion 2.3 while it can be reversed in the output shaft. Provided it is advantageous, the direction of rotation can be otherwise oriented through the intermediate connection of additional gear stages between drive pinion, output pinion, large gear and/or turbine machine pinions. More preferably it is possible to design the turbine machine pinions as internal gears of a planetary gearing, which drives the turbine machine shaft, as is described in U.S. Pat. No. 5,382,132.

Figure 5:
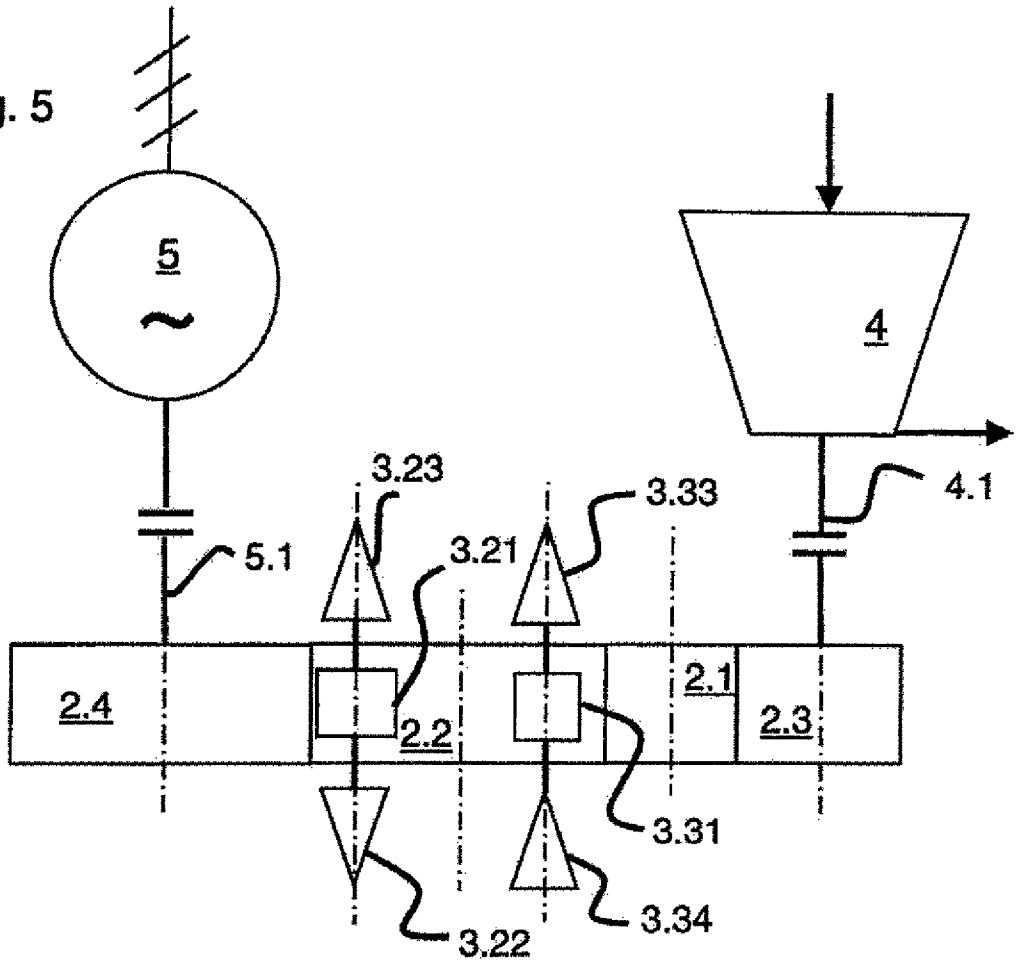
FIG. 5 is a schematic plan view of a gear arrangement of a geared turbine machine with integral gear according to a third embodiment of the present invention.

FIG. 5 shows the substantial elements of a gear arrangement of a geared turbine machine with integral gear according to a third embodiment of the present invention, which substantially corresponds with the first and second version and wherein the first and second aspect of the present invention are likewise jointly realized. Elements corresponding with the first and second embodiment are marked with identical reference numerals so that reference is made to the above-mentioned explanations with respect to the first and second embodiments which are substantially identical in construction, and merely the differences between first, second and third embodiment are discussed in the following.

With the third embodiment, the first turbine machine rotor 3.10 is replaced with an electrical machine input shaft 5.1 connected to an electrical machine 5, for example an electric motor or generator via a coupling. The electrical machine input shaft 5.1 has an electrical machine pinion 2.4 which intermeshes with the large gear 2.2 instead of with a turbine machine pinion 3.11. Through suitable selection of the gear ratios between electrical machine pinion 2.4 and large gear 2.2, a higher rotational speed of the drive pinion 2.1 can for example be stepped down to a lower rotational speed of the electrical machine pinion which—as a function of a mains frequency—amounts to 3000 or 3600 rpm for instance.

If the electrical machine 5 is designed as generator or motor/generator, mechanical power of the steam turbine 1, which is not required for driving the main compressor 4 and the compressor stages of the geared turbine machine 2, can be converted in electric energy and for example be fed into a power supply network.

If the electrical machine 5 is designed as motor or motor/generator, additional rotational moment for driving the main compressor 4 and the compressor stages of the geared turbine machine 2 can conversely be fed into the geared turbine machine 2.

To this end, as additional difference to the first and second embodiment explained above, in the third embodiment according to FIG. 5 a blade wheel of the third turbine machine rotor 3.30 is designed as expander blade wheel 3.34, the other one as compressor blade wheel 3.33 as with the first and second embodiments, which in FIG. 5 is indicated through equal rotation triangles. The geared turbine machine 2 thus has five compressor stages and one expander stage and simultaneously acts as working machine and as power machine (compander). While in the compressor stages a part mass flow of the air compressed in the main compressor 4 is further compressed, a medium, for example residual gas accrued in the process, can be expanded in the expander stage of the expander blade wheel 3.34 and thus additional rotational moment for driving the main compressor 4 and the compressor stages of the geared turbine machine 2 fed into the geared turbine machine 2.

Figure 6:
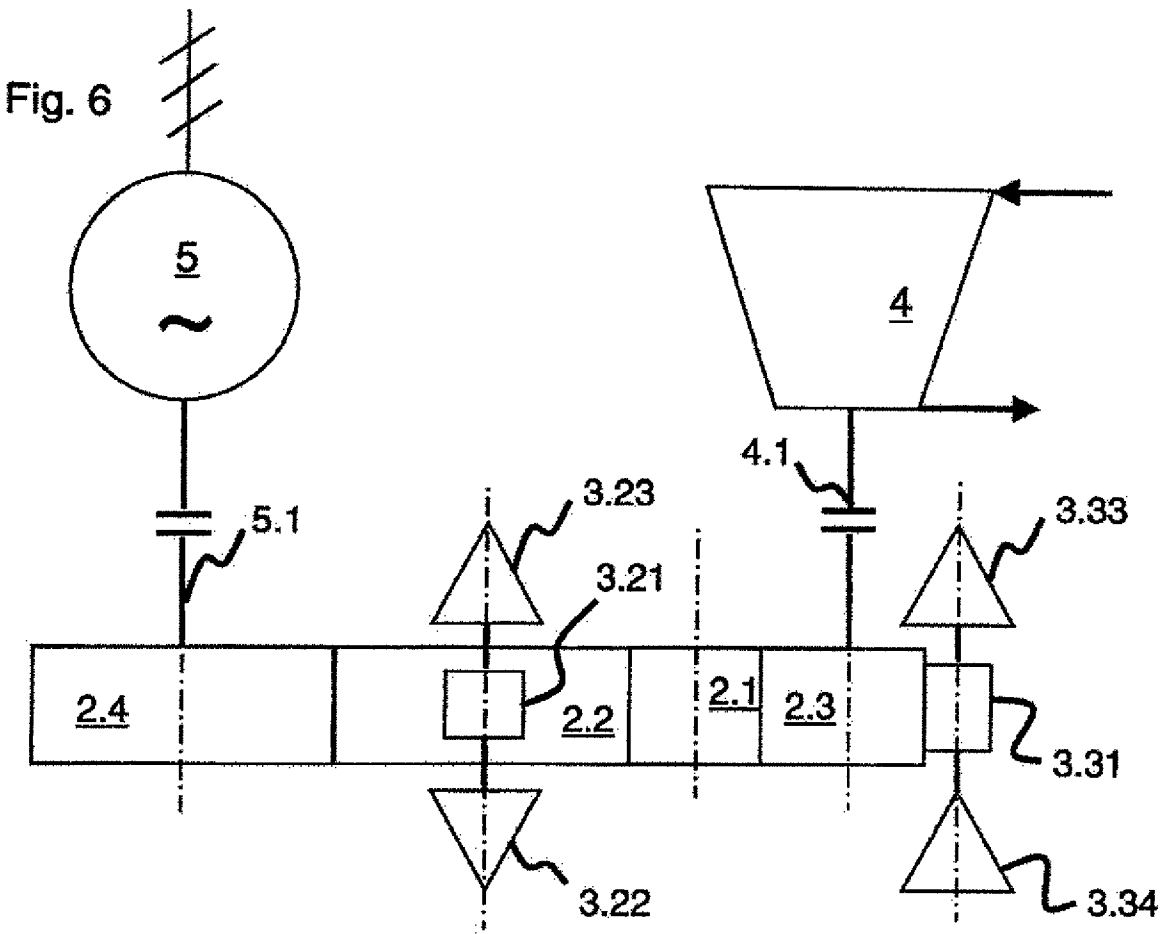
FIG. 6 is a schematic plan view of a gear arrangement of a geared turbine machine with integral gear according to a fourth embodiment of the present invention.

FIG. 6 shows the substantial elements of a gear arrangement of a geared turbine machine with integral gear according to a fourth embodiment of the present invention, which substantially corresponds with the third embodiment and wherein the first and second aspect of the present invention are likewise jointly realized. Elements which correspond with the third embodiment are designated with identical reference numerals, so that reference is made to the above-mentioned explanations with respect to the third embodiment which is substantially identical in construction, and merely the differences between third and fourth embodiment will be discussed in the following.

With the third embodiment the turbine machine pinion 3.21, 3.31 of the second and third turbine machine rotor 3.20, 3.30 both mesh with the large gear 2.2 and their axes of rotation to this end are arranged in a common horizontal plane, in which a parting or separating joint of the housing of the geared turbine machine 2 is also located. With the fourth embodiment, only the turbine machine pinion 3.21 of the turbine machine rotor 3.20 meshes with the large gear 2.2. The turbine machine pinion 3.31 of the turbine machine rotor 3.30, which carries a compressor blade wheel 3.33 and an expander blade wheel 3.34 meshes with the output pinion 2.3, as is also the case in the second embodiment (refer FIG. 4B).

Figure 7:
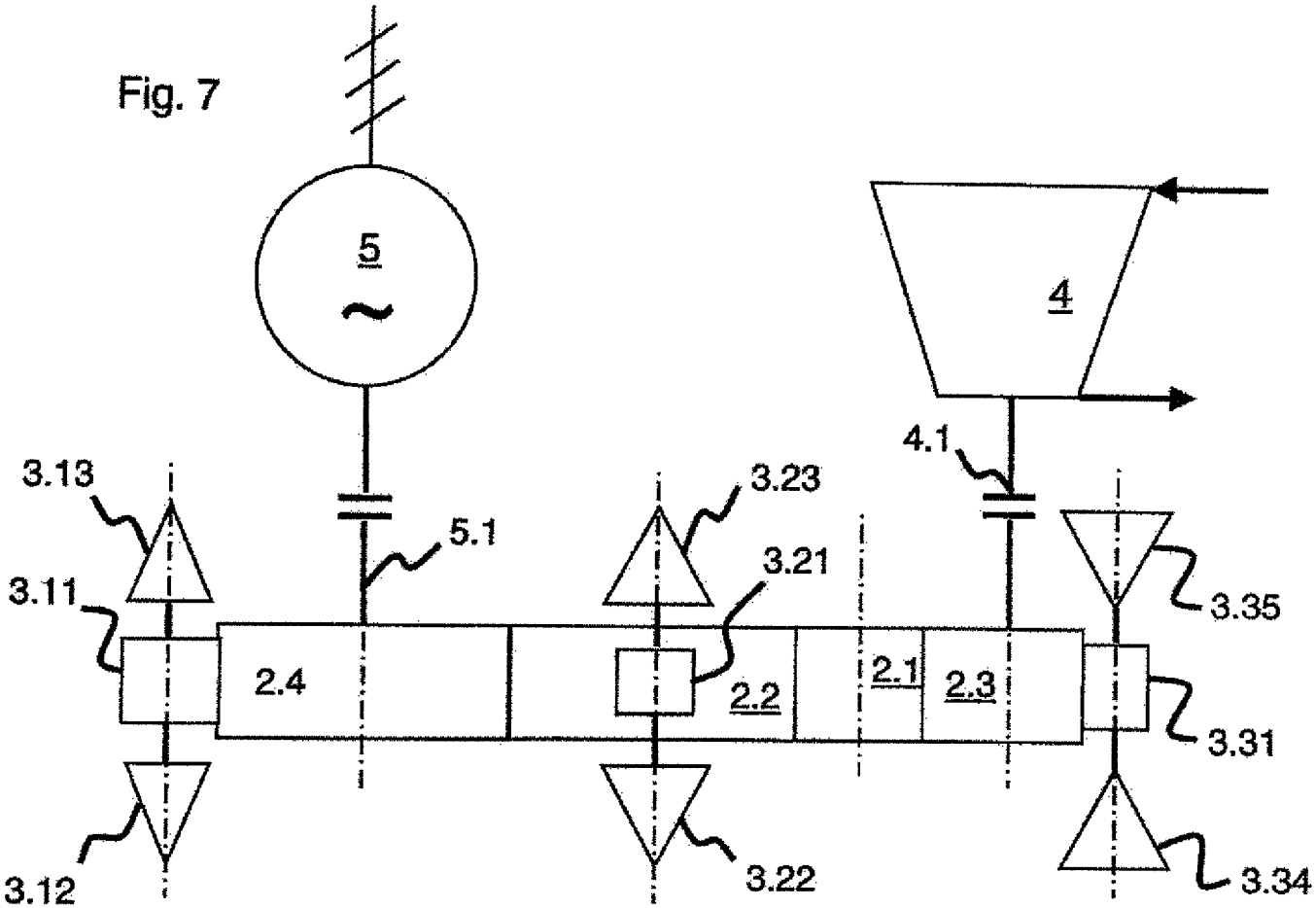
FIG. 7 is a schematic plan view of a gear arrangement of a geared turbine machine with integral gear according to a fifth embodiment of the present invention.

FIG. 7 shows the substantial elements of a gear arrangement of a geared turbine machine with integral gear according to a fifth embodiment of the present invention, which substantially corresponds with the fourth embodiment and wherein the first and second aspect of the present invention are likewise jointly realized. Elements corresponding with the fourth embodiment are marked with identical reference numerals so that reference is made to the above-mentioned explanations with regard to the fourth embodiment which is substantially identical in construction, and merely the differences between fourth and fifth embodiment will be discussed in the following.

In addition to the turbine machine rotor 3.20, whose turbine machine pinion 3.21 meshes with the large gear 2.2, and the turbine machine rotor 3.30, whose turbine machine pinion 3.33 meshes with the output pinion 2.3, a fourth turbine machine rotor 3.10 with two compressor blade wheels 3.12, 3.13 is provided with the fifth embodiment, whose turbine machine pinion 3.11 meshes with the electrical machine pinion 2.4 on the side located opposite the large gear 2.2.

As a further difference to the fourth embodiment explained above, both blade wheels 3.34, 3.35 of the third turbine machine rotor 3.30 are designed as expander blade wheels, which in FIG. 7 is indicated through triangles rotating in the opposite direction to the compressor blade wheels 3.12, 3.13, 3.21 and 3.22. The geared turbine machine 2 thus has four compressor stages and two expander stages and likewise acts as compander. While in the compressor stages a part mass flow further compresses the air compressed in the main compressor, a medium, for example residual gas accrued in the process, can be expanded in the expander stages and in this way additional rotational moment for driving the main compressor 4 and the compressor stages of the geared turbine machine 2 fed in to the geared turbine machine 2.

As with the second embodiment according to FIGS. 3 and 4, the axes of rotation of the turbine machine pinions 3.11, 3.31, of the electrical machine pinion 2.4, of the large gear 2.2, of the drive pinion 2.1, and of the output pinion 2.3 are all preferably located in the same horizontal partition plane of the housing of the geared turbine machine 2.

As with the embodiments described above, some or all compressor blade wheels of the geared turbine machine 2 can compress medium, preferably a part mass flow thereof, which has passed through the main compressor or another medium, for example an additional process gas. The geared turbine machine 2 with its various compressor blade wheels can also compress various media.

As with the previous embodiments, steam turbine, main compressor and the turbine machine rotors of the geared turbine machine can each be operated in optimum rotational speed ranges which can be matched to one another through suitable selection of the gear ratios in the gear of the geared turbine machine 2 and the power gear 2.1, 2.3. More preferably the steam turbine because of the coupling with the slower-rotating main compressor 4 can rotate faster via the rotational speed reduction power gear so that its efficiency improves and smaller steam turbine sizes can be used.

Through the integration of the power gear in the geared turbine machine 2, no separate power gear is required, which results in a more compact machine train and lower manufacturing and assembly expenditure. Because the main compressor housing is separate, a partial decoupling of main compressor and geared turbine machine in terms of vibration is possible.

Because the axial exhaust flow of the turbine outputs only to a side facing away from the exhaust flow, it is possible to arrange a downstream condenser substantially on the same horizontal plane as the steam turbine 1. In contrast with conventional 2-tier machine trains, where the condenser is arranged vertically below the radially exhausting steam turbine, a single-tier machine train makes possible more compact foundations and buildings to accommodate such a train.

The invention was explained above by means of a machine train with a steam turbine as drive unit. Equally, other fluid flow machines can however be employed such as a gas turbine or an expander such as an expansion or residual gas turbine.

The invention is not limited by the embodiments described above which are presented as examples only but can be modified in various ways within the scope of protection defined by the appended patent claims.

We claim:

1. An integrated gear train for a geared turbine machine of a machine train, the gear train comprising:

a drive pinion rotationally fixed to a drive shaft;

an output pinion intermeshing with the drive pinion, the output pinion being rotationally fixed to an output shaft coupled to a main compressor separate from the geared turbine machine;

a large gear meshing with the drive pinion opposite from the output pinion; and at least one turbine machine rotor comprising a turbine machine pinion meshing with the large gear, and a turbine machine shaft rotationally fixed to the pinion for transmitting torque to at least one blade wheel of the geared turbine machine, wherein the main compressor is driven by one of a step up gear and a step down gear.

2. The integrated gear train of claim 1 comprising a plurality of said turbine machine rotors, wherein at least two of said turbine machine pinions mesh with the large gear.

3. The integrated gear train of claim 1 comprising a plurality of said turbine machine rotors, wherein at least one of said turbine machine pinions meshes with the output pinion.

4. The integrated gear train of claim 1 wherein the axes of rotation of the drive pinion, the output pinion, the large gear, and at least one turbine machine shaft are arranged in a substantially common plane.

5. The integrated gear train of claim 1 wherein the large gear and the output pinion are arranged in a common transverse plane of the drive pinion.

6. The integrated gear train of claim 1 wherein the drive pinion rotates with a rotational speed in a ratio of 1.25 to 1.45 with respect to the rotational speed of the output pinion.

7. The integrated gear train of claim 1 wherein the drive pinion rotates with a rotational speed in a ratio of 0.28 to 0.54 with respect to the rotational speed the at least one turbine machine drive pinion.

8. An integrated gear train for a geared turbine machine of a machine train, the gear train comprising:

a drive pinion rotationally fixed to a drive shaft;

an output pinion intermeshing with the drive pinion, the output pinion being rotationally fixed to an output shaft that can be coupled to a main compressor separate from the geared turbine machine;

a large gear meshing with the drive pinion opposite from the output pinion; and at least one turbine machine rotor comprising a turbine machine pinion meshing with the large gear, and a turbine machine shaft rotationally fixed to the pinion for transmitting torque to at least one blade wheel of the geared turbine machine, wherein the drive pinion has teeth with a length which is 1.1 times the length of the teeth of the large gear.

9. A geared turbine machine for a machine train, the geared turbine machine comprising:

a drive pinion rotationally fixed to a drive shaft;

an output pinion intermeshing with the drive pinion, the output pinion being rotationally fixed to an output shaft coupled to a main compressor separate from the geared turbine machine;

a large gear meshing with the drive pinion opposite from the output pinion;

at least one turbine machine rotor comprising a turbine machine pinion meshing with the large gear, and a turbine machine shaft rotationally fixed to the pinion for transmitting torque; and a blade wheel of a compressor or expander stage rotationally fixed to the turbine machine shaft of at least one said turbine machine rotor, wherein the main compressor is driven by one of a step up gear and a step down gear.

10. The geared turbine machine of claim 9 wherein a further blade wheel of a compressor or expander stage is fixed to the turbine machine shaft of the at least one said turbine machine rotor.

11. A machine train comprising:

a drive pinion rotationally fixed to a drive shaft;

a drive unit comprising one of a steam turbine, a gas turbine, and an expander connected to the drive shaft for driving the drive pinion;

an output pinion intermeshing with the drive pinion, the output pinion being rotationally fixed to an output shaft;

a main compressor coupled to the output shaft, wherein the main compressor is driven by a reduction gear;

a large gear meshing with the drive pinion opposite from the output pinion;

at least one turbine machine rotor comprising a turbine machine pinion meshing with the large gear, and a turbine machine shaft rotationally fixed to the pinion for transmitting torque, wherein a majority of the torque is transmitted to the main compressor; and a blade wheel of a compressor or expander stage rotationally fixed to the turbine machine shaft of at least one said turbine machine rotor.

12. The machine train of claim 11 wherein the main compressor is a single shaft compressor designed as one of an axial compressor, a radial compressor, a radial isothermal compressor, and a combined radial-axial compressor.

13. The machine train of claim 11 wherein the dive pinion, the output pinion, the large gear, and the at least one turbine machine rotor are accommodated in a housing, and the main compressor is accommodated in a separate housing.

14. The machine train of claim 11 comprising at least one blade wheel of a compressor stage fixed to the turbine machine shaft of at least one turbine machine rotor, the at least one blade wheel forming a booster compressor which is fed with a part mass flow of medium from the main compressor.

15. The machine train of claim 14 wherein the main compressor has a smallest flow cross section at least 1.1 times the smallest flow cross section of the booster compressor.

16. The machine train of claim 11 wherein the main compressor is arranged on the opposite side of the output pinion and drive pinion from the drive unit.

17. The machine train of claim 11 wherein the drive unit is a steam turbine with an axial outflow.

18. The machine train of claim 17 further comprising a condenser in the outflow of the steam turbine, wherein the condenser and the steam turbine are located in the same horizontal plane.

19. The machine train of claim 11 wherein at least 50% of the power of the drive shaft is transmitted to the output shaft.

20. The machine train of claim 11 further comprising an electrical machine having an input shaft which is coupled to the large gear.

21. The machine train of claim 20 further comprising an electrical machine pinion rotationally fixed to the input shaft, the electrical machine pinion meshing with the large gear.

22. The machine train of claim 20 wherein the axes of rotation of the drive pinion, the output pinion, the large gear, an electrical machine pinion, and a turbine machine pinion are arranged in a substantially common plane.

* * * * *